US011041331B2

(12) United States Patent
Do

(10) Patent No.: US 11,041,331 B2
(45) Date of Patent: Jun. 22, 2021

(54) LATCH HAVING TOOL RECESS IN TRIGGER

(71) Applicant: Alcoa Inc., Pittsburgh, PA (US)

(72) Inventor: Thai Do, Laguna Niguel, CA (US)

(73) Assignee: HOWMET AEROSPACE INC., Pittsburgh, PA (US)

( * ) Notice: Subject to any disclaimer, the term of this patent is extended or adjusted under 35 U.S.C. 154(b) by 396 days.

(21) Appl. No.: 15/084,660

(22) Filed: Mar. 30, 2016

(65) Prior Publication Data

US 2016/0290022 A1 Oct. 6, 2016

Related U.S. Application Data

(60) Provisional application No. 62/142,602, filed on Apr. 3, 2015, provisional application No. 62/242,656, filed (Continued)

(51) Int. Cl.

*E05B 13/00* (2006.01)
*E05B 85/26* (2014.01)

(Continued)

(52) U.S. Cl.

CPC ..... *E05B 85/26* (2013.01); *E05B 13/002* (2013.01); *E05B 35/008* (2013.01); *E05C 3/16* (2013.01);

(Continued)

(58) Field of Classification Search

CPC ..... E05B 85/26; E05B 35/008; E05B 13/002; E05C 19/145; E05C 19/14; E05C 3/30; E05C 3/16; E05C 19/12

See application file for complete search history.

(56) References Cited

U.S. PATENT DOCUMENTS 1,206,342 A 11/1916 Linborg
2,172,955 A 7/1955 Andrews (Continued)

FOREIGN PATENT DOCUMENTS

CN 102191876 A 9/2011
CN 205689005 U 11/2016

(Continued)

OTHER PUBLICATIONS

International Search Report and Written Opinion dated Jun. 9, 2016, issued by the European Patent Office in International (PCT) Patent Application No. PCT/US2016/024836 (13 pages).

(Continued)

*Primary Examiner* — Kristina R Fulton
*Assistant Examiner* — Thomas L Neubauer
(74) *Attorney, Agent, or Firm* — Greenberg Traurig, LLP

(57) ABSTRACT

A latch including a body and an engagement member adapted to engage releasably a clevis, and a handle with a trigger attached pivotally and is pivotable between a first position, in which the trigger is engaged releasably with the clevis, and a second position, in which the trigger is disengaged from the clevis. The trigger includes a recess that receives a tool to facilitate pivoting the trigger from its first position to its second position. The latch may include a drive and the trigger includes a socket adapted to receive a key that facilitates moving a drive to clear the handle and disengaging the trigger with the clevis to open the handle.

7 Claims, 13 Drawing Sheets

Related U.S. Application Data on Oct. 16, 2015, provisional application No. 62/142,601, filed on Apr. 3, 2015, provisional application No. 62/157,197, filed on May 5, 2015.

(51) Int. Cl.

| | |
|---|---|
| ***E05C 19/12*** | (2006.01) |
| ***E05C 19/14*** | (2006.01) |
| ***E05B 35/00*** | (2006.01) |
| ***E05C 3/16*** | (2006.01) |
| ***E05C 3/30*** | (2006.01) |

(52) U.S. Cl.

CPC ..... *E05C 3/30* (2013.01); *E05C 19/12* (2013.01); *E05C 19/14* (2013.01); *E05C 19/145* (2013.01)

(56) References Cited

U.S. PATENT DOCUMENTS

| | | | | |
|---|---|---|---|---|
| 2,712,955 | A | 7/1955 | Andrews | |
| 2,726,889 | A | 12/1955 | Lawson | |
| 2,904,141 | A | 9/1959 | Henrichs | |
| 2,927,812 | A | 3/1960 | Smith et al. | |
| 2,944,848 | A | 7/1960 | Mandolf | |
| 3,030,137 | A * | 4/1962 | Tomkinson | E05C 19/14 292/113 |
| 3,070,395 | A | 12/1962 | Morrison et al. | |
| 3,259,411 | A | 7/1966 | Griffiths | |
| 3,259,412 | A | 7/1966 | Wheeler | |
| 3,341,239 | A | 9/1967 | Wheeler | |
| 3,347,578 | A | 10/1967 | Sheehan et al. | |
| 3,473,693 | A | 10/1969 | Fritz | |
| 3,917,327 | A | 11/1975 | Plasko | |
| 4,053,177 | A | 10/1977 | Stammreich et al. | |
| 4,099,751 | A | 7/1978 | Poe et al. | |
| 4,116,479 | A | 9/1978 | Poe | |
| 4,130,307 | A | 12/1978 | Poe et al. | |
| 4,183,564 | A | 1/1980 | Poe | |
| 4,220,364 | A | 9/1980 | Poe | |
| RE31,935 | E | 7/1985 | Poe | |
| 4,530,529 | A | 7/1985 | Poe et al. | |
| 4,538,843 | A | 9/1985 | Harris | |
| 4,602,812 | A | 7/1986 | Bourne | |
| 4,641,868 | A | 2/1987 | Miron | |
| 4,826,221 | A | 5/1989 | Harmon | |
| 4,828,299 | A | 5/1989 | Poe | |
| 4,858,970 | A | 8/1989 | Tedesco et al. | |
| 4,911,488 | A | 3/1990 | Brackmann et al. | |
| 5,152,926 | A | 10/1992 | Brown | |
| 5,228,730 | A | 7/1993 | Gokcebay et al. | |
| 5,341,752 | A | 8/1994 | Hambleton | |
| 5,609,373 | A | 3/1997 | Gromotka | |
| 5,620,212 | A * | 4/1997 | Bourne | B64D 29/06 292/113 |
| 5,660,295 | A | 8/1997 | Hroma et al. | |
| 5,664,813 | A | 9/1997 | Gromotka | |
| 5,984,382 | A | 11/1999 | Bourne et al. | |
| 6,123,370 | A | 9/2000 | Rozema et al. | |
| 6,343,815 | B1 * | 2/2002 | Poe | E05C 19/145 292/113 |
| 6,361,090 | B1 | 3/2002 | Fan | |
| 6,755,448 | B2 | 6/2004 | Jackson et al. | |
| 6,913,297 | B2 | 7/2005 | Jackson et al. | |
| 7,029,038 | B2 | 4/2006 | Kobrehel | |
| 7,156,429 | B2 | 1/2007 | Eriksson | |
| 7,504,601 | B2 | 3/2009 | Belmond et al. | |
| 7,857,362 | B2 | 12/2010 | Deblock | |
| 8,479,543 | B2 | 7/2013 | Yang et al. | |
| 8,646,819 | B2 | 2/2014 | Do et al. | |
| 8,727,390 | B2 | 5/2014 | Do | |
| 8,864,185 | B2 | 10/2014 | Do | |
| 8,925,979 | B2 * | 1/2015 | Hernandez | E05B 63/143 292/113 |
| 9,353,559 | B2 | 5/2016 | Fabre et al. | |
| 9,587,516 | B2 * | 3/2017 | Fabre | E05B 41/00 |
| 9,677,306 | B2 * | 6/2017 | DeFrance | E05C 19/10 |
| 2002/0000726 | A1 | 1/2002 | Zintler | |
| 2002/0060459 | A1 | 5/2002 | Zintler | |
| 2005/0087996 | A1 | 4/2005 | Jackson et al. | |
| 2006/0214431 | A1 | 9/2006 | Helsley et al. | |
| 2008/0129056 | A1 | 6/2008 | Hernandez et al. | |
| 2011/0109103 | A1 | 5/2011 | Huston et al. | |
| 2012/0102842 | A1 | 5/2012 | Fournie et al. | |
| 2012/0151724 | A1 | 6/2012 | DeFrance et al. | |
| 2015/0184543 | A1 | 7/2015 | Fabre et al. | |
| 2015/0184544 | A1 | 7/2015 | Fabre et al. | |

FOREIGN PATENT DOCUMENTS

| | | | |
|---|---|---|---|
| DE | 202220 | C | 9/1908 |
| DE | 29807738 | U1 | 7/1998 |
| EP | 1091059 | A2 | 4/2001 |
| EP | 2031157 | A1 | 3/2009 |
| FR | 2397503 | A1 | 2/1979 |
| FR | 2852049 | A1 | 9/2004 |
| GB | 191493 | A | 1/1923 |
| GB | 1497982 | A | 1/1978 |
| GB | 1537410 | A | 12/1978 |
| WO | 2010033026 | A1 | 3/2010 |
| WO | 2010149905 | A1 | 12/2010 |

OTHER PUBLICATIONS

Aerospace Latching Systems, Alcoa Fastening Systems, http://www.alcoa.com/fastening_systems/aerospace/en/product.asp?cat_id=213&prod_id=500, pp. I1-I2, 159-160, and i-iii (8 pages).

Fairchild Fasteners, Aerospace Mechanisms, "RAM™ Aerospace Latch Mechanism", 2000 (4 pages).

Rotary Latch #TL18261, Alcoa Fastening Systems, Mar. 2005 (1 page).

English-language translation of WO 2010/149905 A1 (8 pages).

International Search Report and Written Opinion in connection with International Patent Application No. PCT/US2012/028418 entitled "Pin Latch Having Intermediate Position" (13 pages).

International Search Report and Written Opinion in connection with International Patent Application No. PCT/US2012/059206 entitled "Rotary-Handle Latch" dated Jan. 18, 2013 (9 pages).

International Search Report and Written Opinion in connection with International Patent Application No. PCT/US2012/066039 entitled "Pin Latch With Detection Device and Movable Catch-Pin and Intermediate Position With Automatic Return Mechanism" dated Feb. 25, 2013 (15 pages).

International Search Report and Written Opinion in connection with International Patent Application No. PCT/US2011/027871 entitled "Latch With Adjustable Handle" dated Dec. 29, 2011 (17 pages).

International Search Report and Written Opinion in connection with International Patent Application No. PCT/US2011/027671 entitled "Latch With Adjustable Handle" dated Jul. 15, 2011 (8 pages).

International Search Report and Written Opinion in connection with International Patent Application No. PCT/US2011/024031 entitled "Side-Driven Action Pin Latch" dated Jun. 7, 2011 (9 pages).

* cited by examiner

LATCH HAVING TOOL RECESS IN TRIGGER

CROSS-REFERENCE TO RELATED APPLICATIONS

This application relates to and claims the benefit of commonly-owned, (i) U.S. Provisional Patent Application Ser. No. 62/142,602, filed Apr. 3, 2015, entitled "LATCH HAVING TOOL RECESS IN TRIGGER"; (ii) U.S. Provisional Patent Application Ser. No. 62/242,656, filed Oct. 16, 2015, entitled "LATCH HAVING 90 DEGREE TOOL RECESS IN TRIGGER"; (iii) U.S. Provisional Patent Application Ser. No. 62/142,601, filed Apr. 3, 2015, entitled "HOOK LATCH WITH QUARTER-TURN KEY/FLAG SYSTEM"; and (iv) U.S. Provisional Patent Application Ser. No. 62/157,197, filed May 5, 2015, entitled "HOOK LATCH WITH SPECIAL KEY-FLAG SYSTEM," the entirety of each of the foregoing provisional patent applications is incorporated herein by reference.

FIELD OF THE INVENTION

The present invention relates to latches and, more particularly, hook latches having a tool recess in its trigger.

BACKGROUND OF THE INVENTION

Removable and moveable elements installed on exterior surfaces of aerospace vehicles, such as hatches, doors, access panels, engine cowlings, nacelles, and radomes employ latches. Handles mounted on the latches are used to open or close the elements.

SUMMARY OF THE INVENTION

In an embodiment, a latch, including a body having a first end, a second end opposite the first end, and an engagement member at the first end, the engagement member being adapted to engage releasably a clevis; and a handle having a first end, a second end opposite the first end of the handle, and a trigger attached pivotally to the handle, wherein the handle is attached rotatably to the first end of the body and is moveable between a closed position, in which the handle is retained releasably to the body, and an open position, in which the handle is retracted from the body, wherein the trigger is pivotable between a first position, in which the trigger is engaged releasably with the clevis, and a second position, in which the trigger is disengaged from the clevis, and wherein the trigger includes a recess that is sized and shaped to receive a tool for pivoting the trigger from its first position to its second position.

In an embodiment, the recess includes a shape that is selected from the group consisting of rectangular, square, circular, cross, triangular, diamond and star. In an embodiment, the trigger includes a top portion, the recess being formed within the top portion. In an embodiment, the recess is adapted to receive the tool at a ninety degree angle relative to the handle when the handle is in a closed position. In an embodiment, the recess is adapted to receive the tool at an oblique angle relative to the handle when the handle is in a closed position.

In an embodiment, the trigger includes at least one detent extending from the top portion and is adapted to engage releasably the clevis when the trigger is in its first position. In an embodiment, the trigger includes a trigger spring. In an embodiment, the engagement member is a hook. In an embodiment, the tool is a screwdriver.

In another embodiment, a latch including a body having a first end, a second end opposite the first end, and an engagement member at the first end, the engagement member being adapted to engage releasably a clevis; and a handle having a first end, a second end opposite the first end of the handle, and a trigger attached to the handle by a pin having a trigger spring, wherein the handle is attached rotatably to the first end of the body and is moveable between a closed position, in which the handle is retained releasably to the body, and an open position, in which the handle is retracted from the body, wherein the trigger includes a drive having a socket that is sized and shaped to receive a key, wherein the trigger is moveable between a first position, in which the trigger is engaged releasably with the clevis, and a second position, in which the trigger is disengaged from the clevis, and wherein the handle is adapted to be opened from its closed position by engaging the key with the drive to facilitate movement of the trigger from its first position to its second position.

In an embodiment, the key is adapted to turn the drive one-quarter turn and clear the drive from the handle. In an embodiment, the key is further adapted to toggle the drive against the trigger-spring until the drive stops against the pin and is further adapted to be pushed toward the second end of the handle to move the trigger to its second position. In an embodiment, the socket is a D-shaped socket. In an embodiment, the key is a quarter-turn-key. In an embodiment, the key is adapted to remain engaged with the socket when the handle is in its open position. In an embodiment, when the handle is moved from its closed position to its opened position, the key is adapted to be turned to lock the trigger. In an embodiment, the trigger includes a top portion, the socket being formed within the top portion. In an embodiment, the trigger includes at least one detent extending from the top portion and is adapted to engage releasably the clevis when the trigger is in its first position. In an embodiment, the engagement member is a hook.

In an embodiment, a body having a first end, a second end opposite the first end, and an engagement member at the first end, the engagement member being adapted to engage releasably a clevis; and a handle having a first end, a second end opposite the first end of the handle, and a trigger attached to the handle by a pin having a trigger spring, wherein the handle is attached rotatably to the first end of the body and is moveable between a closed position, in which the handle is retained releasably to the body, and an open position, in which the handle is retracted from the body, wherein the trigger includes a drive having a socket that is sized and shaped to receive a key, and a slide positioned at a bottom portion of the trigger and above the pin, wherein the slide is moveable slidably relative to the trigger from a first position to a second position that is toward the second end of the handle, wherein the trigger is moveable between a first position, in which the trigger is engaged releasably with the clevis, and a second position, in which the trigger is disengaged from the clevis, and wherein the handle is adapted to be opened from its closed position by engaging the key with the drive to facilitate the movement of the trigger from its first position to its second position and movement of the slide from its first position to its second position to clear the slide from the handle.

In an embodiment, the socket is a tear drop-shaped socket and the key includes a tear drop-shaped end. In an embodiment, the key is adapted to remain engaged with the socket when the handle is in its open position. In an embodiment, when the handle is moved from its closed position to its open position, the key is adapted to move towards the first end of the handle to lock the trigger. In an embodiment, the trigger includes a top portion, the socket being formed within the top portion. In an embodiment, the trigger includes at least one detent extending from the top portion and is adapted to engage releasably the clevis when the trigger is in its first position. In an embodiment, the engagement member is a hook.

DETAILED DESCRIPTION OF THE DRAWINGS

Figure 1:
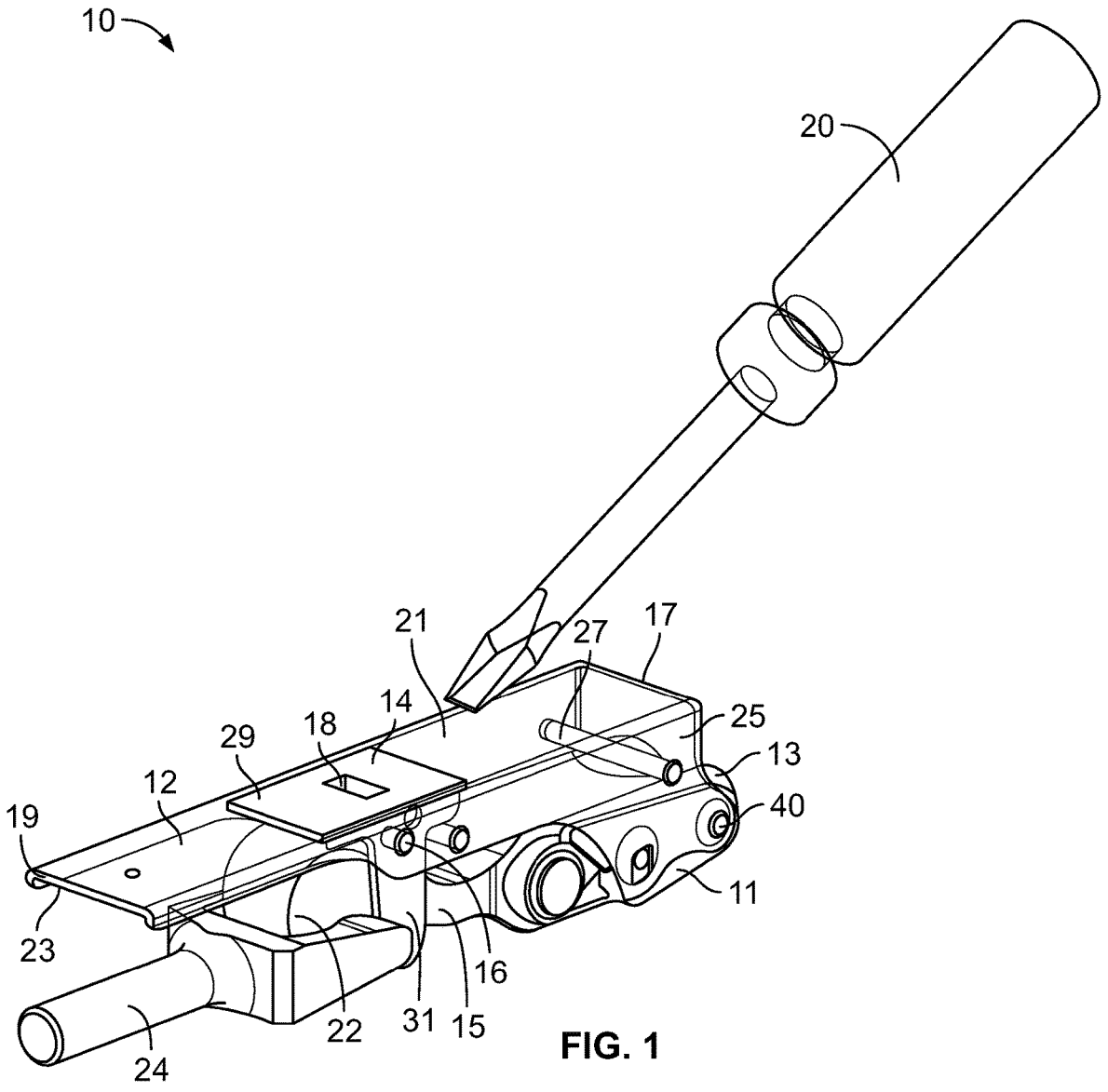
FIG. 1 is a top perspective view of an embodiment of a latch.

Referring to FIG. 1, in an embodiment, a latch 10 includes a body 11 having a first end 13 and a second end 15 opposite the first end 13, and a handle 12 attached rotatably (pivotally) to the first end 13 of the body 11. In an embodiment, the handle 12 rotates relative to the body 11 between a closed position, in which the handle 12 is releasably retained to the body 11, and an open position, in which the handle 12 fully extends from the body 11.

Figure 2B:
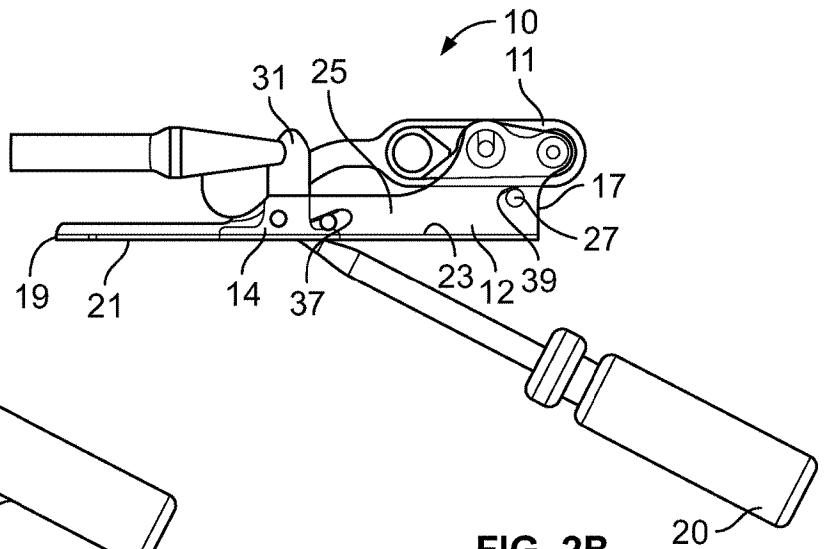
FIGS. 2A through 2E are side elevational views of the latch shown in FIG. 1, showing sequentially the operation thereof.
Figure 2A:
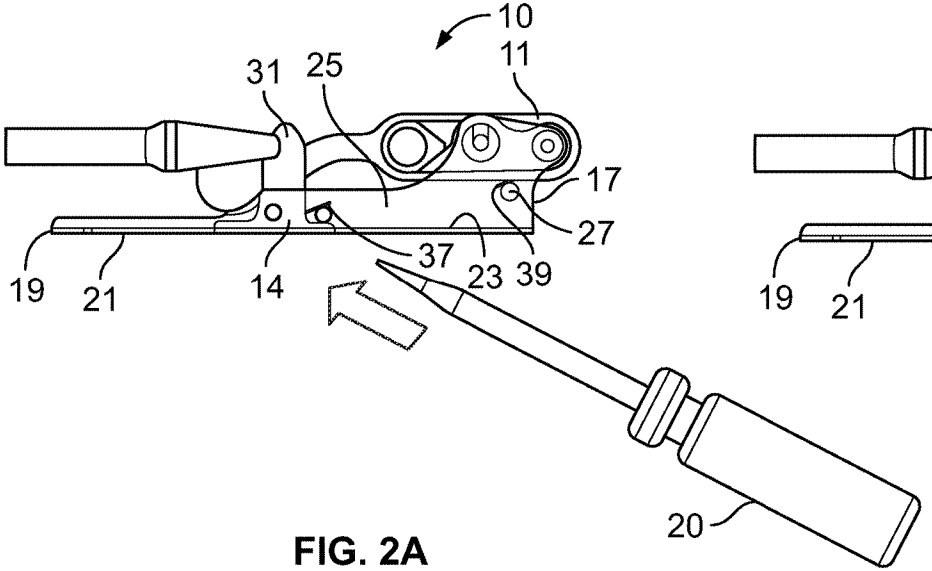
Figure 2C:
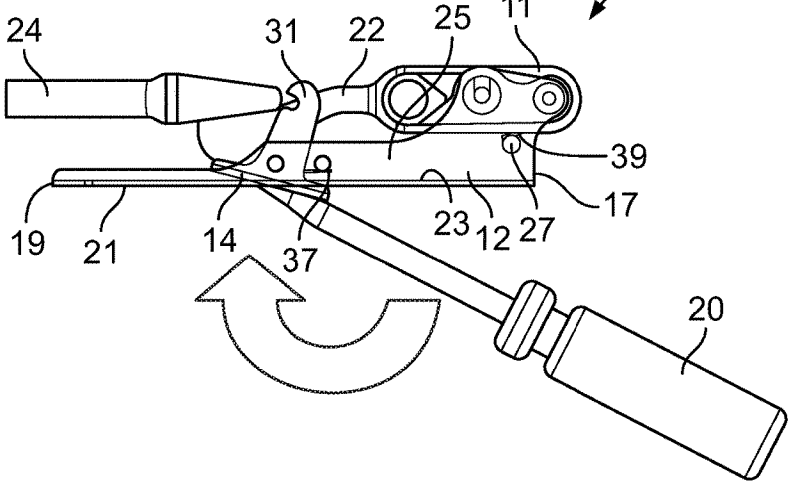
Figure 2D:
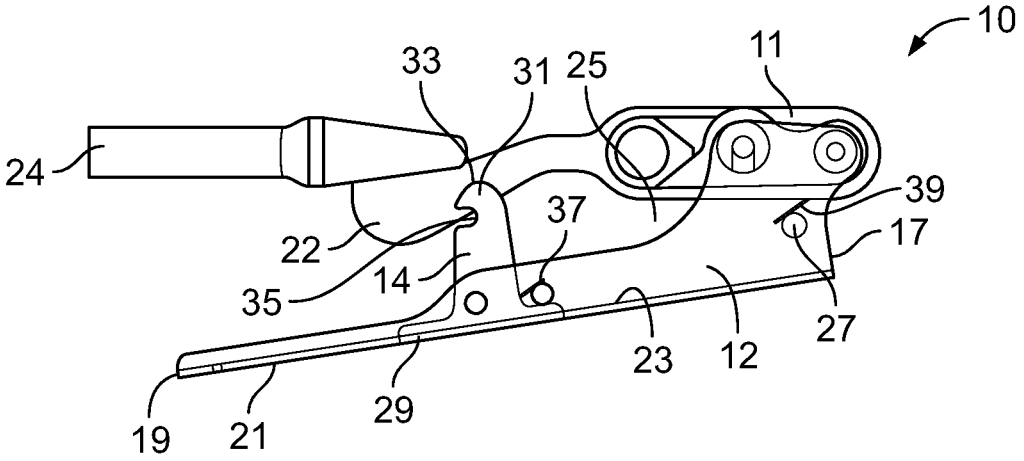
Figure 2E:
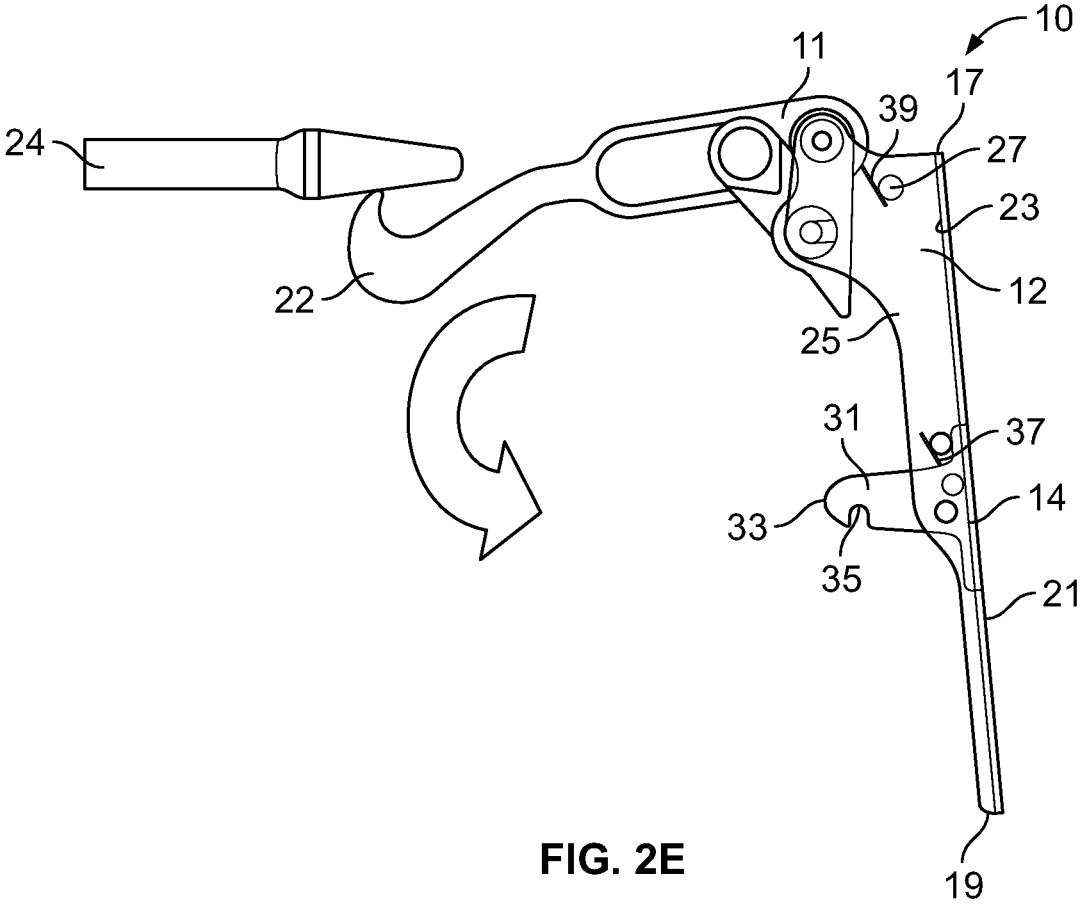

Referring to FIGS. 1 through 2E, in an embodiment, the handle 12 includes a first end 17 and a second end 19 opposite the first end 17, an exterior surface 21, an interior surface 23, and opposing side members 25. In an embodiment, the handle 12 includes a rectangular-shaped aperture extending from the exterior surface 21 to the interior surface 23 (not shown in the Figures).

In an embodiment, the first end 17 of the handle 12 is attached pivotally to the first end 13 of the body 11 by a handle pivot pin 40 that extends through the opposing side members 25. In an embodiment, the handle pivot pin 40 includes bushings. In an embodiment, a back spring 39 surrounds the handle pivot pin 40 and engages a bushing 27 that includes a pin that extends through the opposing side members 25 to facilitate opening the handle from its closed position.

In an embodiment, the handle 12 includes a trigger 14 that is attached rotatably (pivotally) to the handle 12 via a rivet/bushing 16. In an embodiment, the trigger 14 includes a rectangular-shaped top portion 29 that is sized and shaped to mate with the aperture of the handle 12 and a pair of opposing detents 31, each having a cupped tip 33 and a slot 35, and depending from the top portion 29 of the trigger 14. In an embodiment, the trigger 14 includes a trigger spring 37.

In an embodiment, the trigger 14 includes a tool recess 18 formed with the top portion 29. In an embodiment, the recess 18 is sized and shaped to receive an external tool 20 such as a flat-head screw driver. In an embodiment, the recess 18 is rectangular in shape. In other embodiments, the recess 18 can be other shapes and sizes, such as square, circular, triangular, diamond, cross, star, etc. In an embodiment, the body 11 includes a hook 22 at the first end thereof and engages releasably a clevis 24. In another embodiment, the body 11 includes other types of grasping or locking members adapted to engage releasably the clevis 24. In an embodiment, the slots 35 of the detents 31 of the trigger 14 are adapted to engage the clevis 24 when the handle 12 is in its closed position.

Referring to FIGS. 2A through 2E, in an embodiment, the latch 10 is opened from its closed position as follows. First, the tool 20 is placed in position and engages the recess 18 of the trigger 14 until it stops (FIGS. 2A and 2B). In an embodiment, the tool 20 is inserted obliquely relative to the top portion 29 of the trigger 14 and the recess 18. The tool 20 is rotated towards the second end 19 of the handle 12 to rotate the trigger 14 from a first engaged position to a second disengaged position such that the detents 31 of the trigger 14 are disengaged from the clevis 24 and allow the handle 12 to drop to a free-travel position (see FIGS. 2C and 2D). It is noted that the tool 20 only interacts directly with the trigger 14 to disengage the trigger 14 from the clevis 24 and allows the handle 14 to drop to its free-travel position. The tool 20 is removed from the recess 18 of the trigger 14, with the trigger spring 37 resetting the trigger 14 back to its first position, and the handle 12 is rotated to a full open position to disengage the hook 22 from the clevis 24 (see FIG. 2E).

Figure 3:
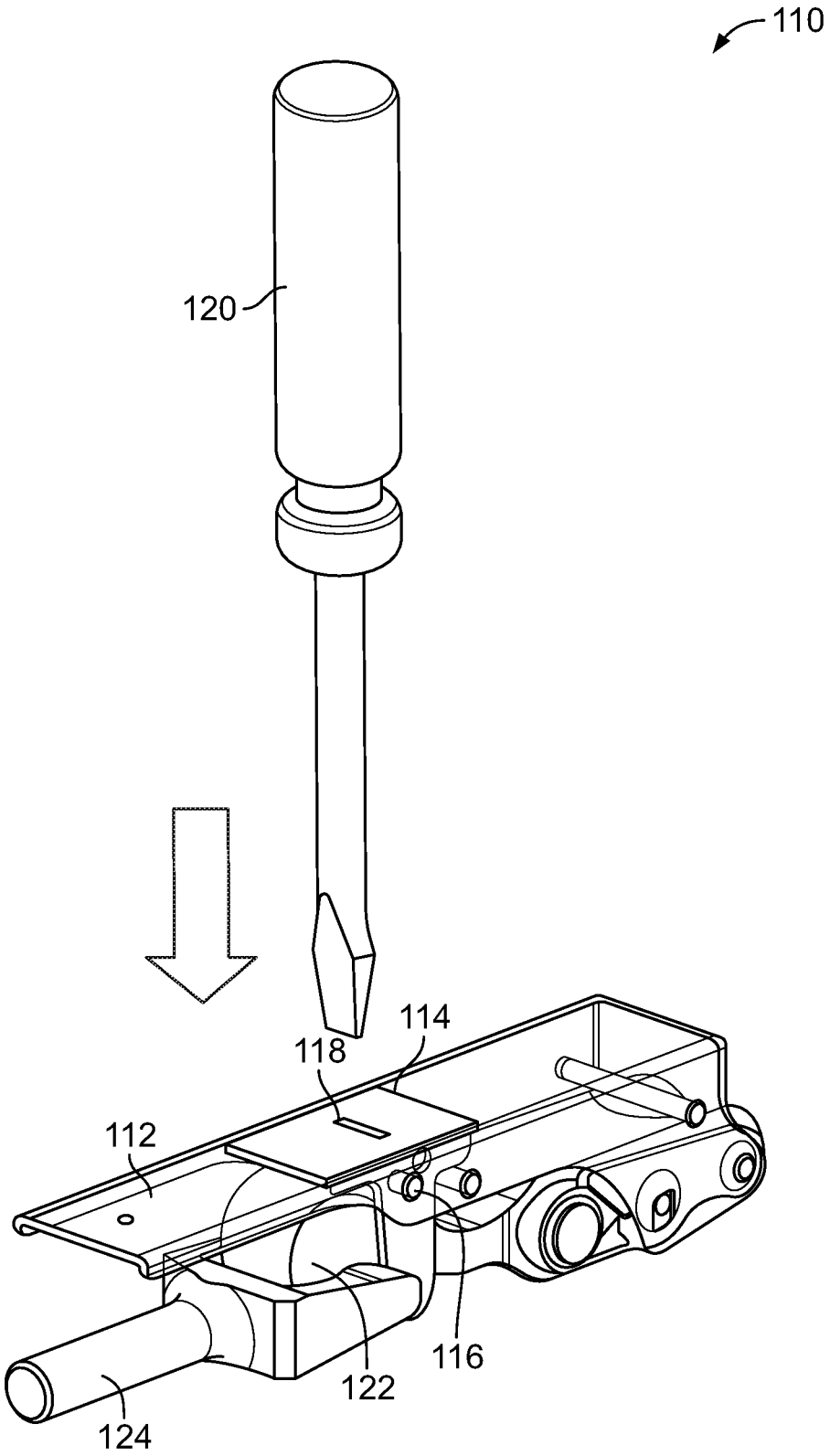
FIG. 3 is a top perspective view of another embodiment of a latch.
Figure 4B:
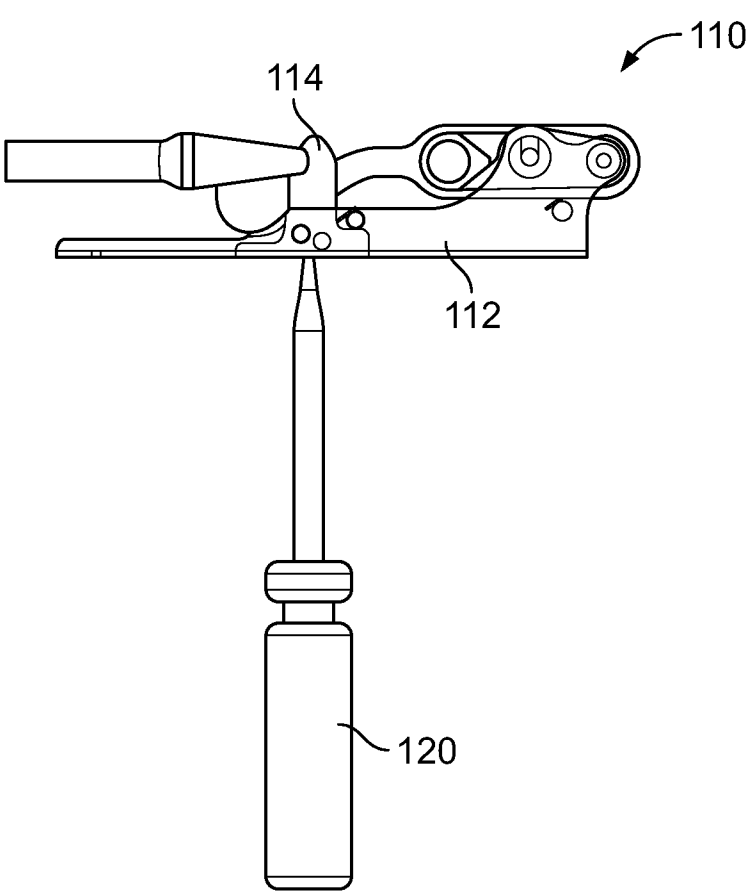
FIGS. 4A through 4E are side elevational views of the latch shown in FIG. 3, showing sequentially the operation thereof.
Figure 4A:
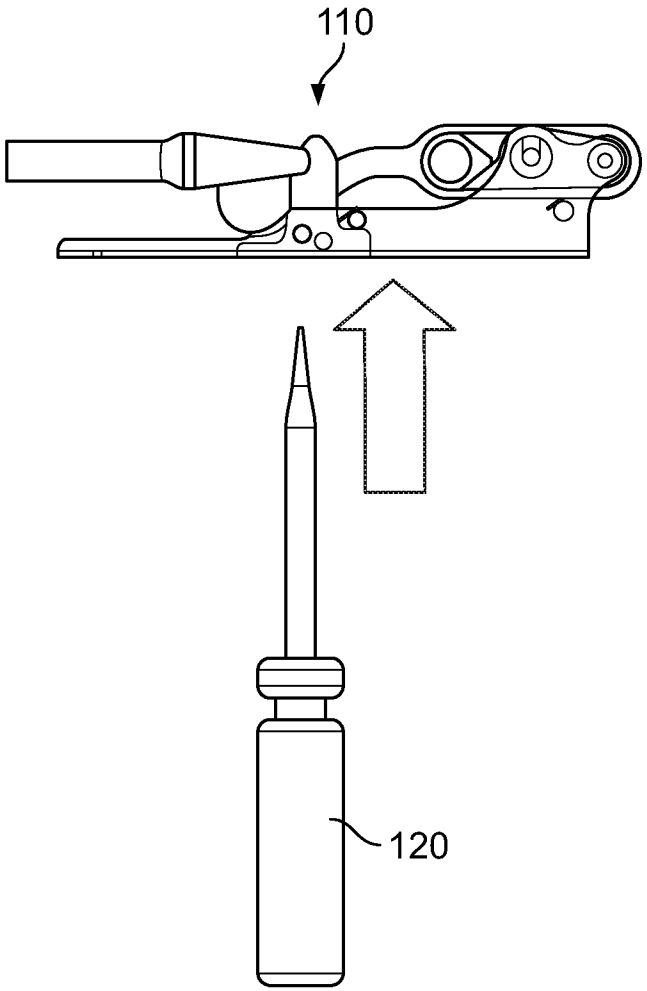
Figure 4C:
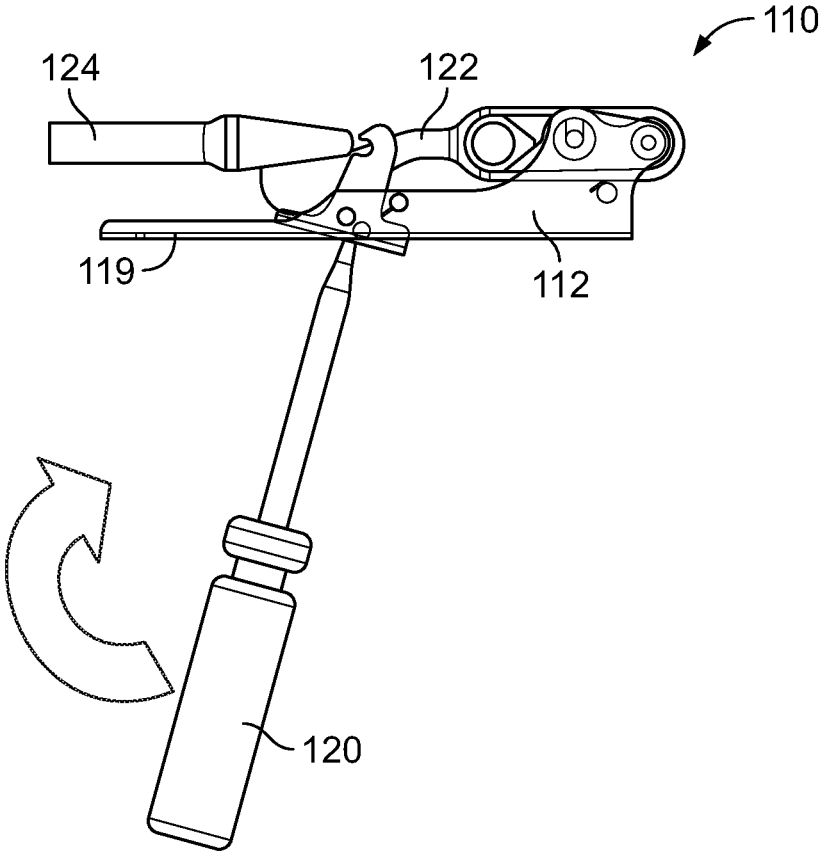
Figure 4D:
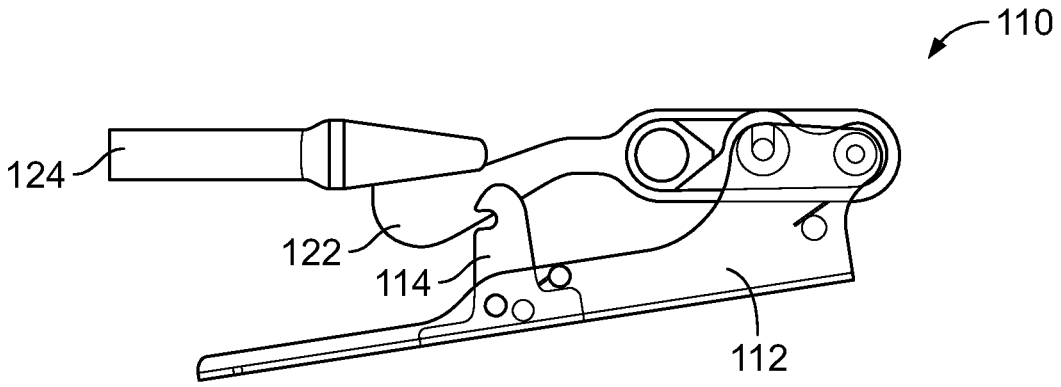
Figure 4E:
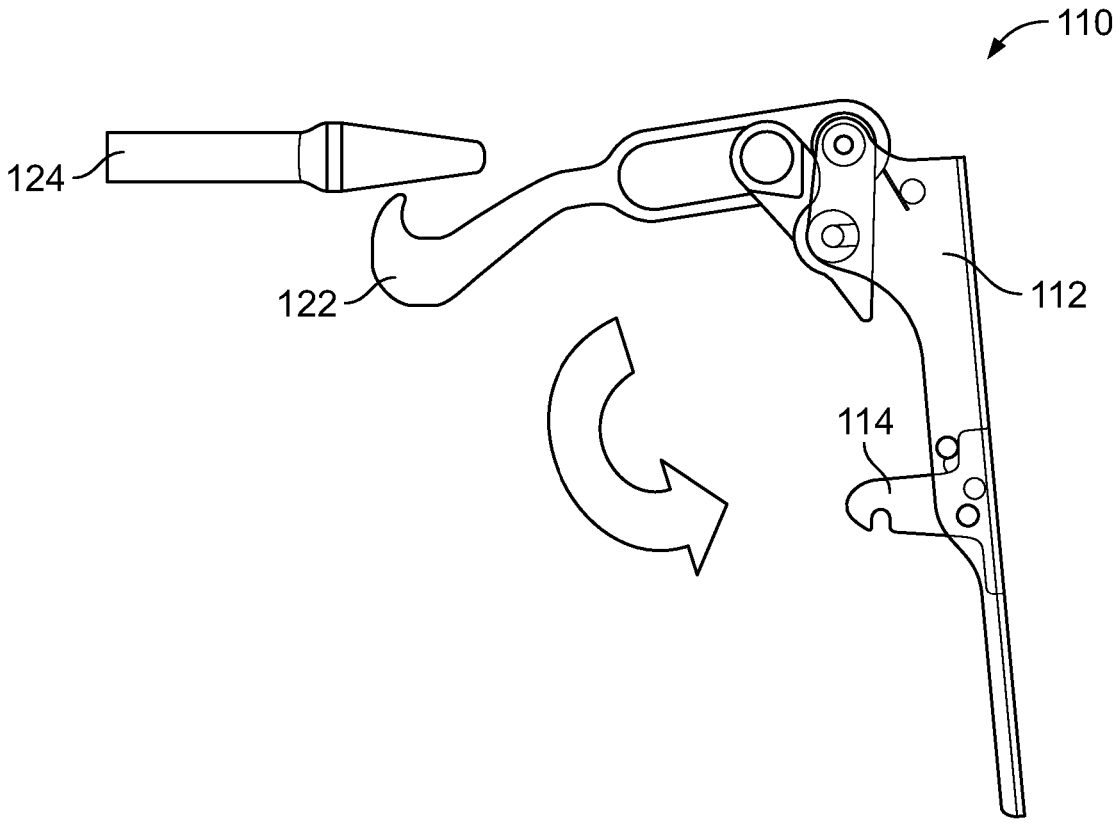

An alternate embodiment of a latch constructed in accordance with the present invention is illustrated in FIGS. 3 through 4E. To facilitate consideration and discussion, all elements, whether or not illustrated in FIGS. 3 through 4E, which correspond to the elements described above with respect to FIGS. 1 through 2E, have been designated by corresponding reference numerals increased by one hundred (100). The embodiment represented by FIGS. 3 through 4E is constructed and operates in the same manner as the latch 10 shown in FIGS. 1 through 2E, except as described below.

Referring to FIG. 3, in another embodiment, the latch 110 includes a handle 112 that is rotatable from and between an open position to a closed position, and a trigger 114 attached to the handle 112 via a rivet/bushing 116. In an embodiment, the trigger 114 includes a tool recess 118 formed therein, the recess 118 being sized and shaped to receive an external tool 120 such as a flat-head screw driver. In an embodiment, the tool recess 118 is sized, shaped and positioned within the trigger 114 such that when the external tool 120 is received initially therein, the longitudinal axis of the tool 120 is positioned ninety degrees (90°) relative to the handle 112 and the trigger 114 when the handle 112 is in a closed position. In an embodiment, the latch 110 includes a hook 122 that engages a clevis 124.

Referring to FIGS. 4A through 4E, in an embodiment, the latch 110 is opened from its closed position as follows. First, the tool 120 is placed in position and engages the recess 118 of the trigger 114 until it stops (FIGS. 4A and 4B). Once again, the longitudinal axis of the tool 120 is positioned ninety degrees (90°) relative to the handle 112 and the trigger 114 when the handle 112 is in its closed position. The tool 120 is then rotated towards a second end 119 of the handle 112 to disengage the trigger 114 from the clevis 124 and allow the handle 112 to drop to a free-travel position (see FIGS. 4C and 4D). It is noted that the tool 120 only interacts directly with the trigger 114 to disengage the trigger 114 from the clevis 124 and allowing the handle 114 to drop to its free-travel position. The tool 120 is removed and the handle 112 is rotated to a full open position to disengage the hook 122 from the clevis 124 (see FIG. 4E).

An alternate embodiment of a latch constructed in accordance with the present invention is illustrated in FIGS. 5 through 7D. The embodiment represented by FIGS. 5 through 7D is constructed and operates in a similar manner as the latches 10, 110 shown in FIGS. 1 through 4E, except as described below.

Figure 5:
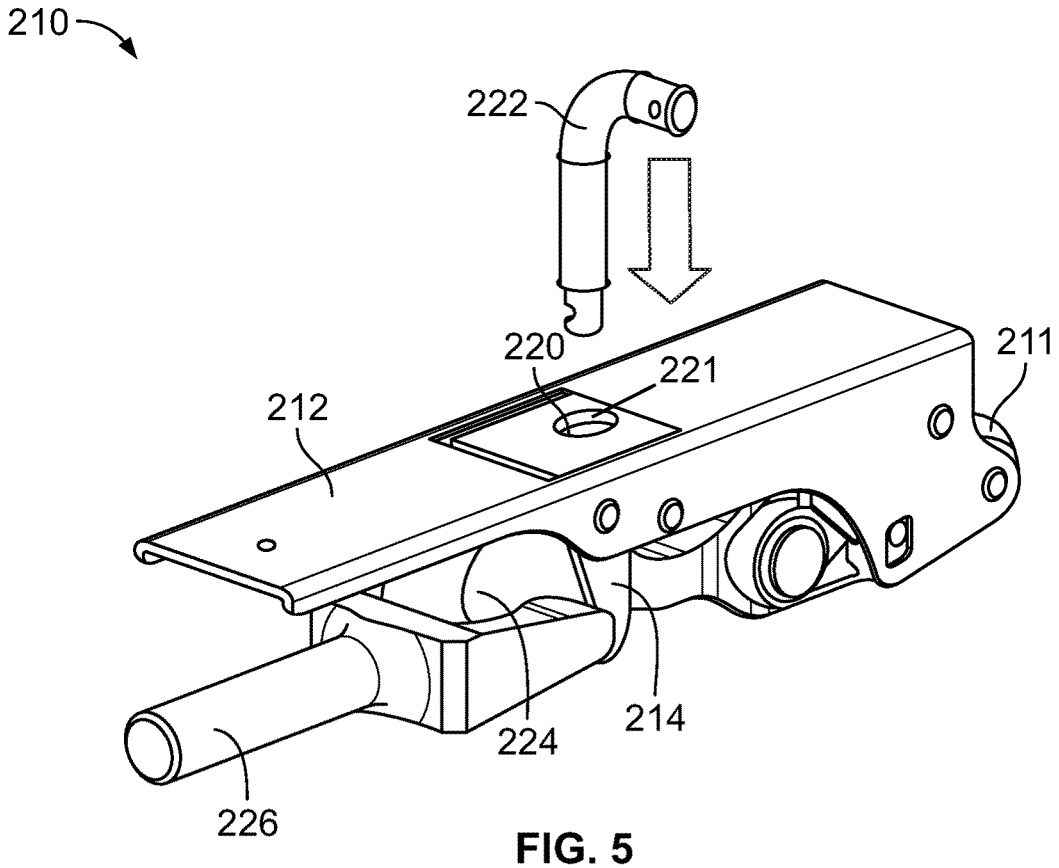
FIG. 5 is a top perspective view of another embodiment of a latch.
Figure 6:
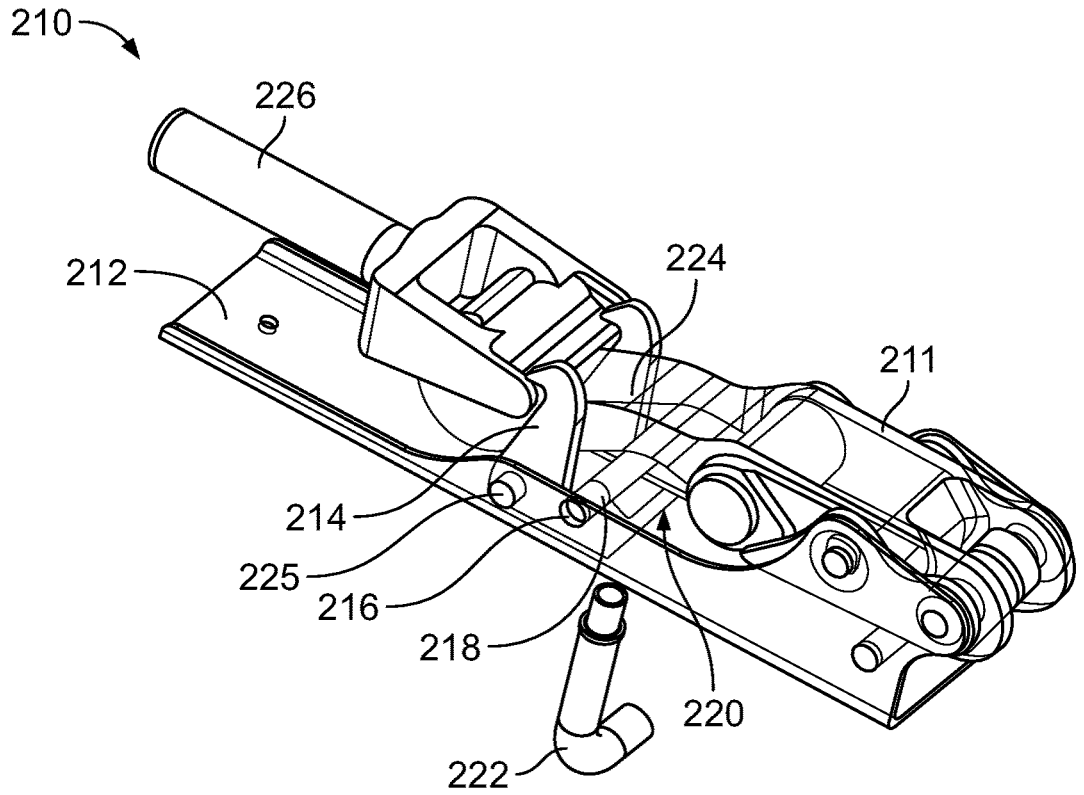
FIG. 6 is a bottom perspective view of the latch shown in FIG. 5.
Figure 7A:
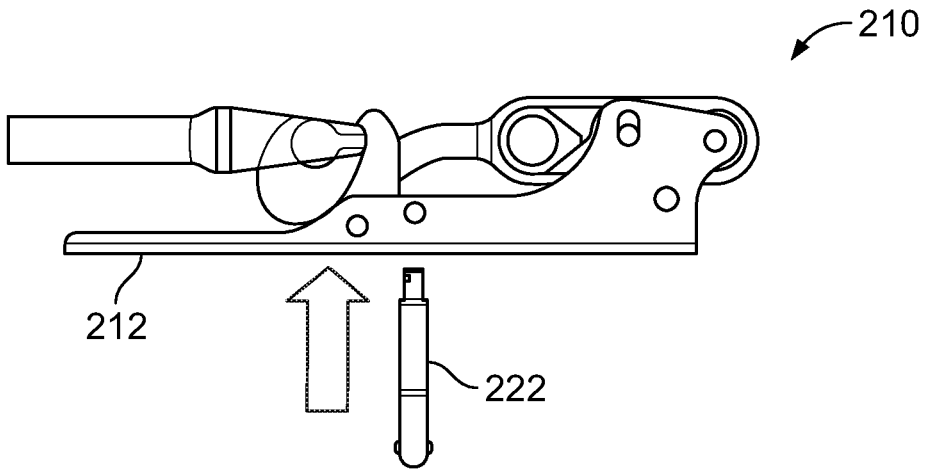
FIGS. 7A through 7D are side elevational views of the latch shown in FIG. 5, showing sequentially the operation thereof.
Figure 7B:
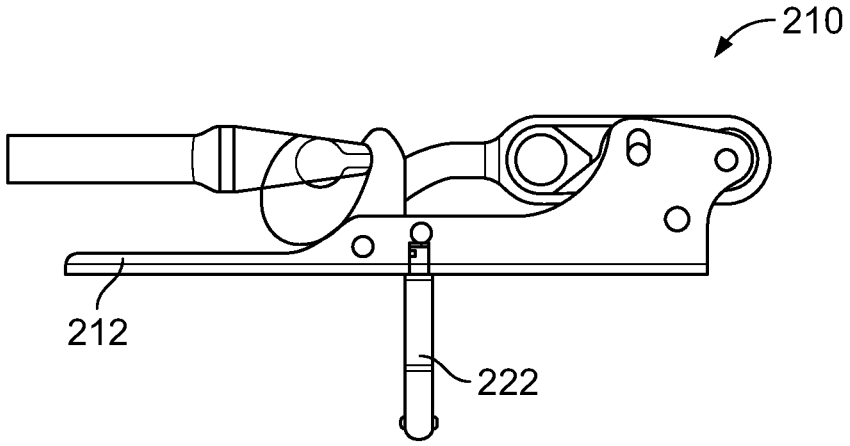
Figure 7C:
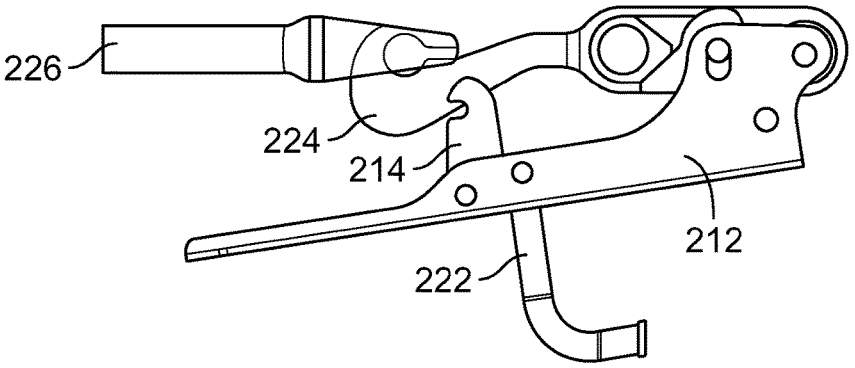
Figure 7D:
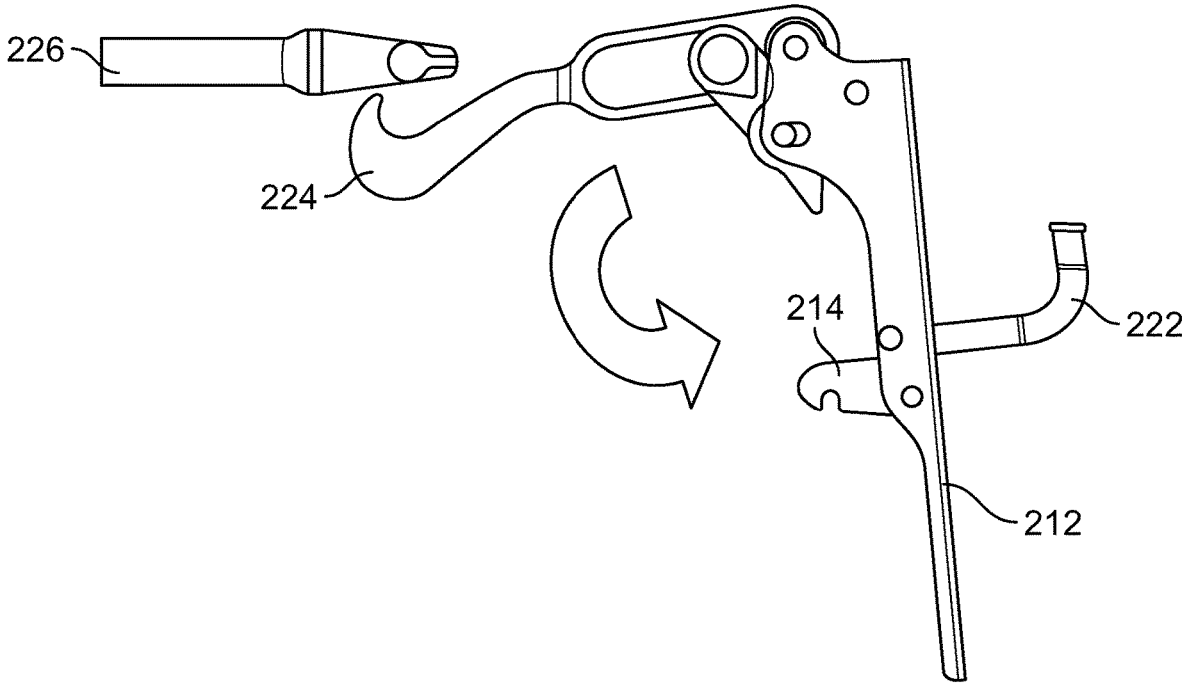

Referring to FIGS. 5 and 6, in another embodiment, a latch 210 includes a body 211 and a handle 212 attached rotatably (pivotally) and is rotatable from and between an open position to a closed position, and a trigger 214 attached to the handle 212 via a pin 225 with a trigger-spring 218 wrapped around a pin 216. In an embodiment, the trigger 214 includes a drive 220 embedded therein, the drive 220 having a socket 221 that is sized and shaped to receive a key 222. In an embodiment, the socket 221 is a "D" socket. In an embodiment, the key 222 is a quarter-turn-key. In an embodiment, the latch 210 includes a hook 224 that engages a clevis 226. In another embodiment, the latch 210 includes other types of grasping or locking members that are adapted to engage the clevis 226.

Referring to FIGS. 7A through 7D, in an embodiment, the latch 210 is opened from its closed position by first aligning the key 222 with the drive 220 prior to the key's 222 engagement with the drive 220. Once the key 222 is fully engaged with the drive 220, the key 222 is turned one-quarter turn counterclockwise to unlock the trigger 214 (i.e., to clear the drive 220 from the handle 212), as well as to toggle the drive 220 against the trigger-spring 218 until the drive 220 stops against the pin 216. While in this position, the key 222 is pushed toward the front of the handle 212 to allow the trigger 214 to disengage the clevis 226. In this manner, the handle 212 rotates to a free-travel position. The handle 212 is then rotated to disengage the hook 224 from the clevis 226 until it stops at a full open position.

To close the latch 210 from a full open position, the handle 212 is rotated until both the hook 224 and the trigger 214 engage the clevis 226. The key 222 is then turned one-quarter turn clockwise to lock the trigger 214 before the key 222 is enabled to be pulled out.

An alternate embodiment of a latch constructed in accordance with the present invention is illustrated in FIGS. 8 through 10D. To facilitate consideration and discussion, all elements, whether or not illustrated in FIGS. 8 through 10D, which correspond to the elements described above with respect to FIGS. 6 through 7D, have been designated by corresponding reference numerals increased by one hundred (100). The embodiment represented by FIGS. 8 through 10D is constructed and operates in the same manner as the latch 210 shown in FIGS. 6 through 7D, except as described below.

Figure 8:
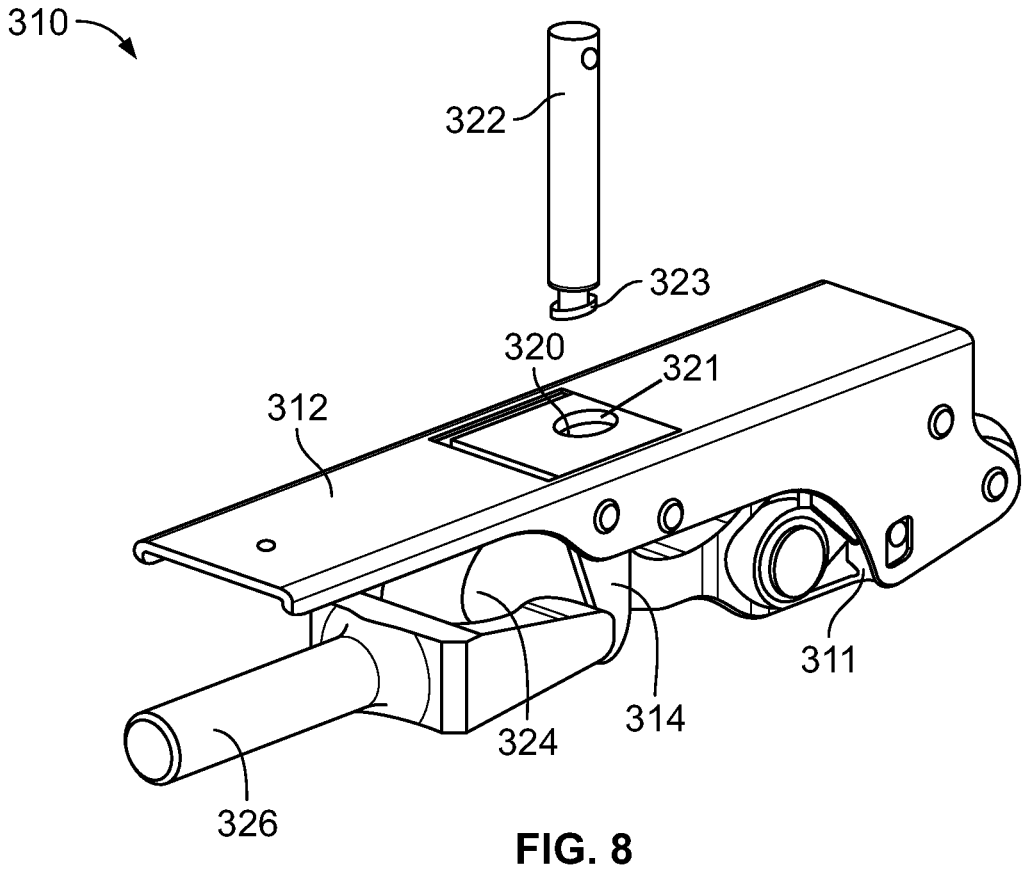
FIG. 8 is a top perspective view of another embodiment of a latch.
Figure 9:
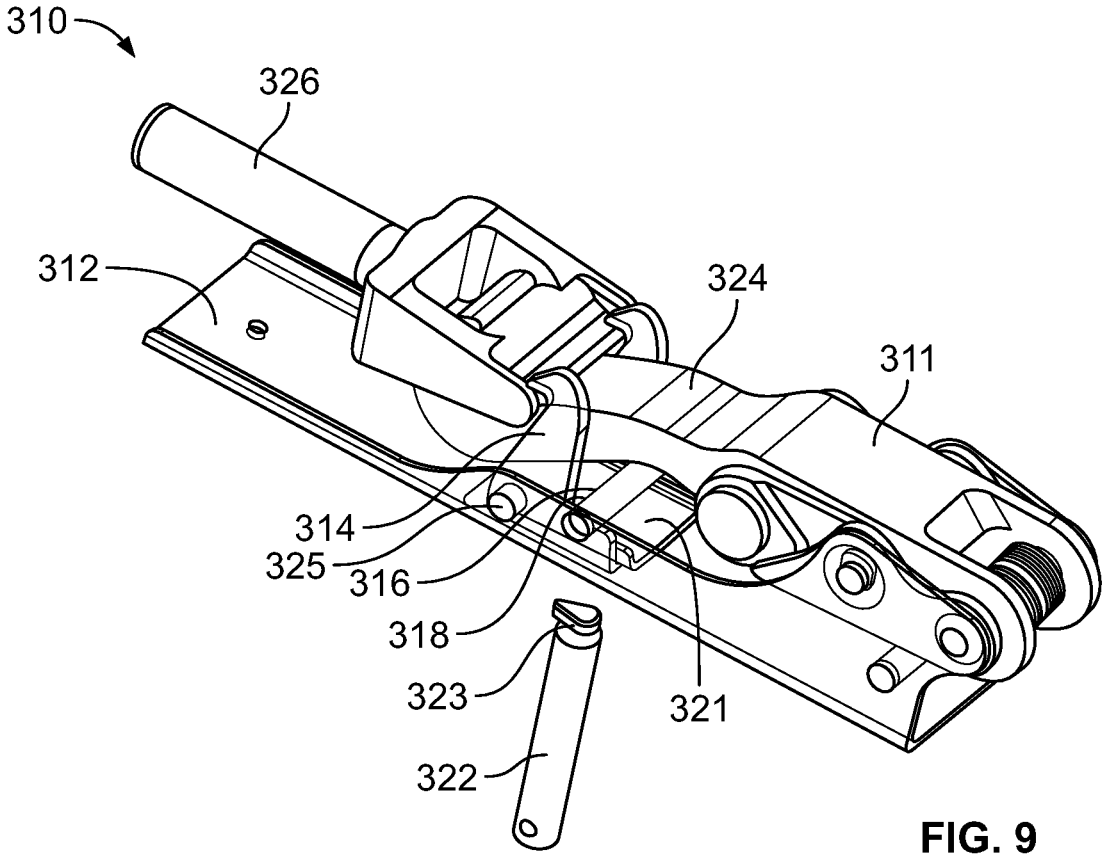
FIG. 9 is a bottom perspective view of the latch shown in FIG. 8.

Referring to FIGS. 8 and 9, in another embodiment, a latch 310 includes a body 311 having a handle 312 attached rotatable (pivotally) to the body 311. In an embodiment, the handle 312 is rotatable from and between an open position to a closed position. A trigger 314 is attached to the handle 312 via a pin 325 with a trigger-spring 318 wrapped around a pin 316. In an embodiment, the trigger 314 includes a drive 320 embedded therein, the drive 320 having a socket 321 that is sized and shaped to receive a key 322. In an embodiment, the socket 321 is a "tear drop" shaped socket and the key 322 has a tear drop-shaped end 323. In an embodiment, the key 322 is elongated in shape.

Figure 10A:
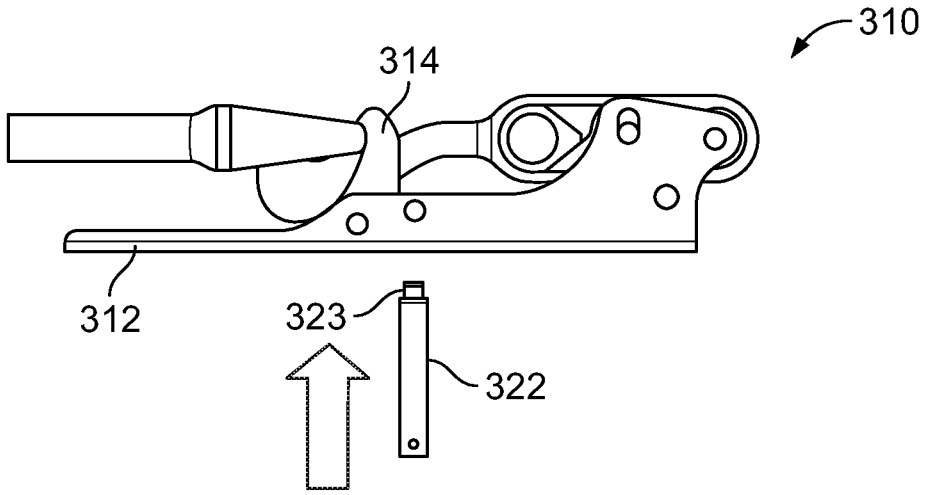
FIGS. 10A through 10D are side elevational views of the latch shown in FIG. 8, showing sequentially the operation thereof.
Figure 10B:
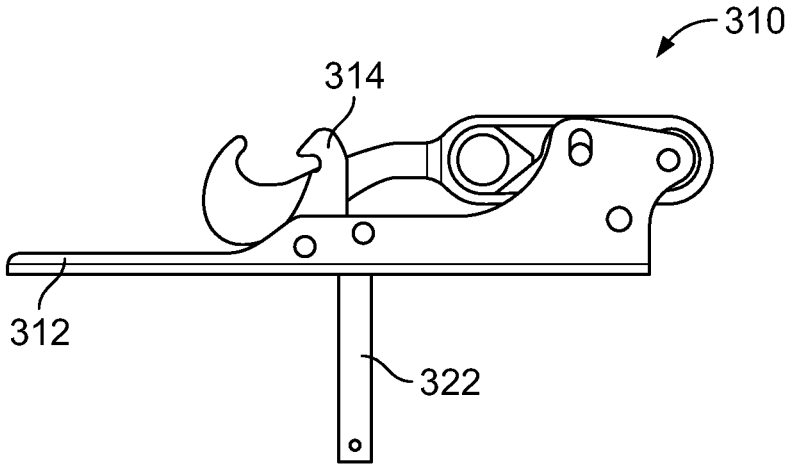
Figure 10C:
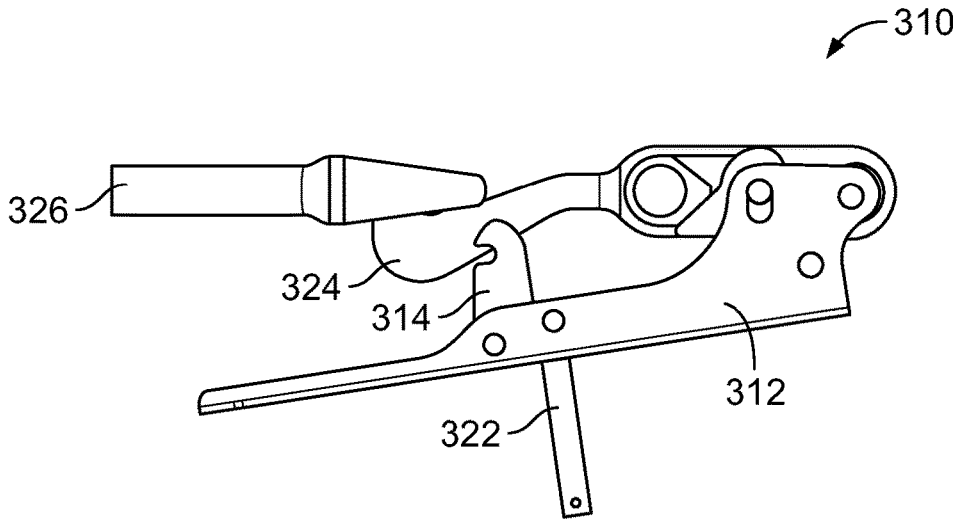
Figure 10D:
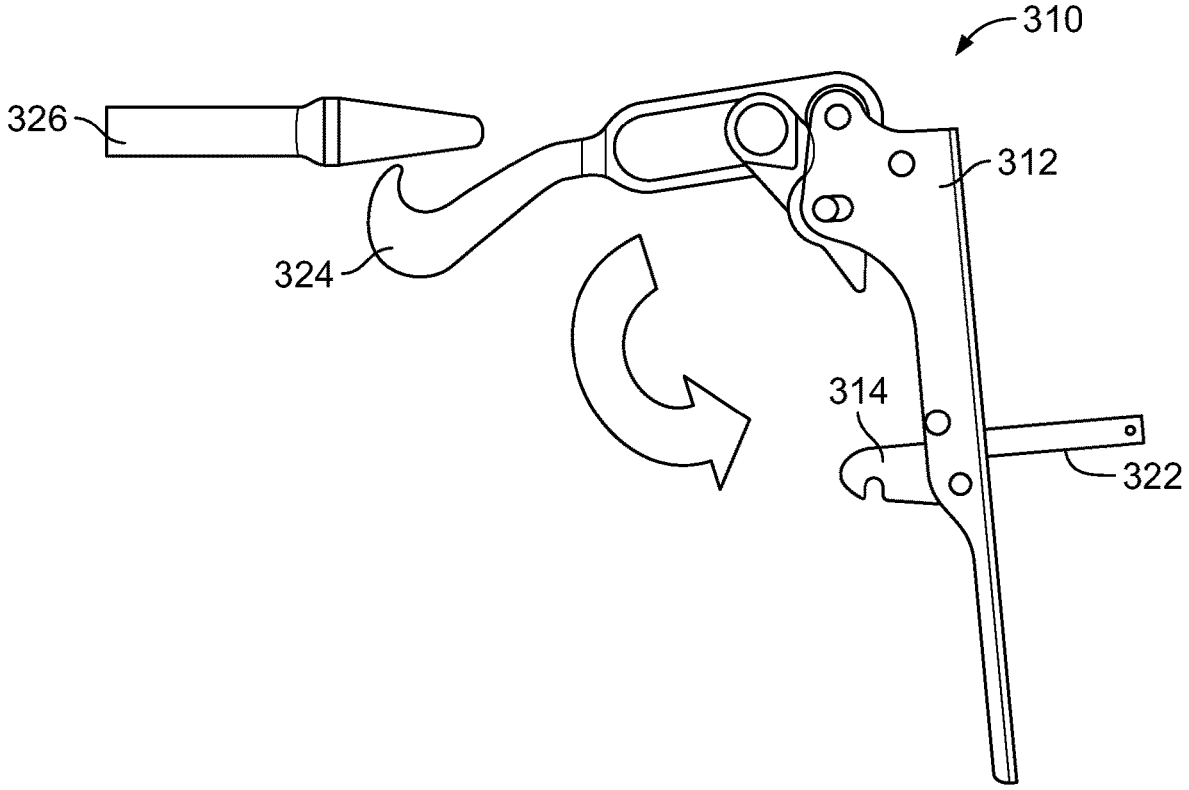

Referring to FIGS. 10A through 10D, in an embodiment, the latch 310 is opened from its closed position by first aligning the key 322 with the drive 320 of the trigger 314 prior to the key's 322 engagement with the drive 320, as shown in FIG. 10A. Once the key 322 is fully engaged with the drive 320 and stopped by the slide 321, as shown in FIG. 10B, the key 322 is pushed slightly toward the front of the handle 312 to move the slide 321 from its first position to its second position to clear the slide 321 from the handle 312 and unlock the trigger 314. While in this position, the key 322 is moved forward toward the front of the handle 312 to allow the trigger 314 to disengage the clevis 326. The key 322 remains in the drive 320 of the trigger 314. In this manner, the handle 312 rotates to a free-travel position. The handle 312 is then rotated to disengage the hook 324 from the clevis 326 until it stops at a full open position. The key 322 continues to remain in the drive 320 of the trigger 314.

To close the latch 310 from a full open position, the handle 312 is rotated until both the hook 324 and the trigger 314 engage the clevis 326. The key 322 is then pushed toward the back of the handle 312 until stopped in order to lock the trigger 314 before the key 322 is enabled to be pulled out.

It should be understood that the embodiments described herein are merely exemplary and that a person skilled in the art may make many variations and modifications without departing from the spirit and scope of the invention. All such variations and modifications are intended to be included within the scope of the invention.

What is claimed is:

1. A latch, comprising:

a body having a first end, a second end opposite the first end, and an engagement member at the first end, the engagement member being adapted to engage releasably an external clevis that is distinct from the latch; and a handle having a first end, a second end opposite the first end of the handle, and a trigger attached to the handle by a pin having a trigger spring, wherein the handle is attached rotatably to the first end of the body and is moveable between a closed position, in which the handle is retained releasably to the body, and an open position, in which the handle is retracted from the body, wherein the trigger includes a drive having a socket that is sized and shaped to receive a key, a base having a first surface, a first pair of sidewalls extending from the first surface, and a slide including a base slidably juxtaposed with the first surface and a second pair of sidewalls, each of which is slidably juxtaposed with a corresponding one of the first pair of sidewalls, wherein the slide is moveable slidably relative to the trigger from a first position to a second position that is toward the second end of the handle, wherein the trigger is moveable between a first position, in which the trigger is engaged releasably with the clevis, and a second position, in which the trigger is disengaged from the clevis, and wherein the handle is adapted to be opened from its closed position by engaging the key with the drive to facilitate the movement of the trigger from its first position to its second position by pushing the key toward the second end of the handle to facilitate movement of the slide from its first position to its second position to clear the slide from the handle.

2. The latch of claim 1, wherein the socket is a tear drop-shaped socket and the key includes a tear drop-shaped end.

3. The latch of claim 1, wherein the key is adapted to remain engaged with the socket when the handle is in its open position.

4. The latch of claim 1, wherein when the handle is moved from its closed position to its open position, the key is adapted to move towards the first end of the handle to lock the trigger.

5. The latch of claim 1, wherein the base of the trigger includes a second surface opposite the first surface, the socket being formed within the second surface.

6. The latch of claim 5, wherein the trigger includes at least one detent extending from the base and is adapted to engage releasably the clevis when the trigger is in its first position.

7. The latch of claim 1, wherein the engagement member is a hook.

* * * * *